US007845329B2

(12) United States Patent
Ono et al.

(10) Patent No.: US 7,845,329 B2
(45) Date of Patent: Dec. 7, 2010

(54) ENGINE FOR MOTORCYCLE

(75) Inventors: Takahiro Ono, Kobe (JP); Yoshio Okada, Kakogawa (JP); Tomohiro Kanazawa, Osaka (JP); Hironori Tomari, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 102 days.

(21) Appl. No.: 11/354,898

(22) Filed: Feb. 16, 2006

(65) Prior Publication Data

US 2006/0196749 A1 Sep. 7, 2006

(30) Foreign Application Priority Data

Feb. 21, 2005 (JP) ..... P2005-044103
Mar. 16, 2005 (JP) ..... P2005-074436

(51) Int. Cl.
*F02M 1/16* (2006.01)

(52) U.S. Cl. ..... 123/179.1; 123/196 R; 123/90.27

(58) Field of Classification Search ..... 123/196, 123/197.1, 196 R, 197.19, 90.27, 90.31; 60/313; 180/219, 309, 296; *F02M 1/16*
See application file for complete search history.

(56) References Cited

U.S. PATENT DOCUMENTS 3,991,734 A * 11/1976 Martin ..... 123/179.19
4,903,483 A * 2/1990 Atsuumi et al. ..... 60/313
5,154,144 A * 10/1992 Okui et al. ..... 123/90.27
5,934,234 A * 8/1999 Shichinohe et al. ..... 123/90.31
7,040,454 B2 * 5/2006 Kawamoto et al. ..... 184/106
2002/0043237 A1 * 4/2002 Nomura et al. ..... 123/196 R
2004/0244760 A1 * 12/2004 Kawamoto et al. ..... 123/196 R

FOREIGN PATENT DOCUMENTS

JP 63-129107 6/1988
JP 4-219463 8/1992
JP 08-086223 4/1996
JP 08086223 A * 4/1996
JP 8-326639 12/1996
JP 10-218073 8/1998
JP 10-331655 12/1998
JP 2003-247467 9/2003
JP 2004-225572 8/2004
WO 2005/005808 1/2005

* cited by examiner

*Primary Examiner*—Michael Cuff
*Assistant Examiner*—Keith Coleman
(74) *Attorney, Agent, or Firm*—Wenderoth, Lind & Ponack, L.L.P.

(57) ABSTRACT

The invention relates to a motorcycle engine arrangement which transmits a starting power to a crank shaft from a starter motor via a power transmission mechanism and a one-way clutch. The one-way clutch is installed at one end portion of the crank shaft, and a starter gear or a starter sprocket having a diameter smaller than an outer diameter of a clutch outer member is provided on the crank shaft portion further toward an outer side in an axial length direction of the crank shaft than the clutch outer member of the one-way clutch. Preferably, the clutch outer member is arranged further toward an outer side in the axial length direction of the crank shaft than a sprocket wheel for driving a cam or a gear for driving a cam provided at one end portion of the crank shaft.

20 Claims, 8 Drawing Sheets

ENGINE FOR MOTORCYCLE

BACKGROUND OF THE INVENTION

1. Field of the Invention

The present invention relates to an engine for a motorcycle that transmits a starting power to a crank shaft from a starter motor via a power transmission mechanism and a one-way clutch.

2. Description of the Related Art

In an engine for a motorcycle provided with a starter apparatus, it is preferable that a one-way clutch is arranged on a crank shaft for reducing mechanical loss of starting power, and the one-way clutch is normally installed in an end portion of the crank shaft. Further, the one-way clutch is arranged at an outermost end in an axial length direction of the crank shaft in order to couple the one-way clutch to a starter motor arranged in an outer portion of a crank case so as to freely transmit a power.

Further, in the engine for the motorcycle, as a mechanism for transmitting rotation of the crank shaft to a cam shaft for intake and exhaust valves, there are a gear transmission mechanism including a plurality of gears, and a chain transmission mechanism including a sprocket and a chain. It is advantageous for the chain transmission mechanism to have few parts, be low in weight, and allow for freedom of layout.

FIG. 5 shows a conventional engine for a motorcycle provided with a chain transmission mechanism for driving a cam shaft and a starter apparatus (Japanese Unexamined Patent Publication No. 8-86223). FIG. 6 is a view as seen from an arrow VI in FIG. 5 showing a state in which a cover 115 for a starter apparatus and the like are detached. FIG. 7 is an enlarged view of a cross section of FIG. 6 taken along a line through respective axes. A crank case is omitted and the cover is partially shown by two dotted line.

In FIG. 5, a cam chain chamber 104 is formed in one end portion of a crank case 100 in an axial length direction of a crank shaft 105 and the cover 115 for the starter apparatus is attached thereto. One end portion of the crank shaft 105 extends to a starter chamber 106 within the cover 115 through the cam chain chamber 104, a cam drive sprocket 110 is formed in the crank shaft 105 within the cam chain chamber 104, and a one-way clutch 102 for the starter apparatus is attached to the crank shaft 105 portion within the starter chamber 106. A generator rotor 103*a* of a generator 103 is attached to the other end portion of the crank shaft 105. A cam chain 108 is wound between the cam drive sprocket 110 and a pair of cam drive sprockets 107 attached to cam shafts mounted on a cylinder head.

In FIG. 7, the one-way clutch 102 is constituted of a closed-end tubular clutch outer member 116 firmly fixed (spline fitted) to an end portion of the crank shaft 105, a clutch inner member (a clutch hub) 118 rotatably supported by a boss portion 116*c* of the clutch outer member 116 via a needle bearing 117, and a clutch element 119 such as a sprag or the like arranged between the clutch outer member 116 and the clutch inner member 118, and is structured so as to transmit power in an engine normal rotational direction only to the clutch outer member 116 from the clutch inner member 118.

A starter gear 120 is provided in the clutch inner member 118 of the one-way clutch 102, and the starter gear 120 is coupled to an output pinion 126 of a starter motor 125 via first and second idle gears 121 and 122 (a gear transmission mechanism) arranged within the cover 115 (FIG. 5) so that the power of the starter motor 125 is transmitted to the starter gear 120. The idle gears 121 and 122 are respectively provided with small-diameter tooth portions 121*a* and 122*a* and large-diameter tooth portions 121*b* and 122*b*, and are rotatably supported respectively by idler shafts 127 and 128. The starter gear 120 is engaged with the small-diameter tooth portion 121*a* of the first idle gear 121, the large-diameter tooth portion 121*b* of the first idle gear 121 is engaged with the small-diameter tooth portion 122*a* of the second idle gear 122, and the large-diameter tooth portion 122*b* of the second idle gear 122 is engaged with the output pinion (gear) 126 of the starter motor 125.

In FIG. 6, the idler shaft 127 of the first idle gear 121 engaging with the starter gear 120 is arranged in a rear side of an area (or range) surrounded by the cam chain 108 (a so-called cam chain line), the second idler shaft 128 is arranged in a rear upper side of the first idler shaft 127, and the starter motor 125 is arranged in a rear upper side of the second idler shaft 128.

In the case that the starter motor 125 is driven (rotated) at a time of starting the motorcycle engine mentioned above, the power of the starter motor 125 is transmitted to the starter gear 120 from the output pinion 126 via the second and first idle gears 122 and 121, and is transmitted to the crank shaft 105 from the starter gear 120 via the one-way clutch 102 in FIG. 5.

If the starter gear 120 on the crank shaft 105 is arranged in an inner side of the one-way clutch 102 in the axial length direction of the crank shaft 105 as shown in FIG. 7, there is generated a disadvantage that a diameter of the starter gear 120 is limited. In other words, due to the necessity of avoiding interference with a mating face 130 of a clutch cover for housing a clutch for connecting and disconnecting a wheel drive force for the motorcycle, a pulsar 112, a chain guide support portion 132 and the like in FIG. 6, a diameter of the starter gear 120 is limited. On the other hand, if it is intended to increase the diameter of the starter gear 120, an entirety of the crank case must be enlarged. Further, in FIG. 7, in the first idle gear 121, since the small-diameter tooth portion 121*a* is positioned in an inner side in the axial length direction of the crank shaft 105 rather than the clutch outer member 116, and since the large-diameter tooth portion 121*b* is positioned in an outer side in the crank axial length direction rather than the clutch outer member 116, a boss portion 121*c* having a fixed length in the axial length direction of the crank shaft 105 is necessary for coupling the large and small tooth portions 121*b* and 121*a*, and therefore, the first idle gear 121 is enlarged and the weight is increased.

Further, as shown in FIG. 6, in the structure in which the idler shaft 127 of the first idle gear 121 engaging with the starter gear 120 is arranged in the rear side (the outer side) of an area surrounded by the cam chain 108, due to the necessity of avoiding interference with the mating face 130 of the clutch cover and the chain guide 133, and the first idle gear 121, a center distance L1 between an axial core of the crank shaft 105 and an axial core of the first idler shaft 127 is elongated, a distance W1 from the axial core of the crank shaft 105 to the axial core of the output pinion 126 of the starter motor 125 is accordingly elongated, the starter gear 120 is enlarged and the starter apparatus itself is enlarged. Further, since the starter motor 125 having a great weight is positioned rearward apart from the crank shaft 105, it is possible to prevent a mass of the engine from being concentrated.

In this case, with respect to the starter apparatus as shown in FIGS. 5 to 7, the starter apparatus shown in FIG. 8 is structured such that the possibility of the interference mentioned above can be removed by making the diameter of the starter gear 120 smaller than the clutch outer member 116. However, if the diameter of the starter gear 120 is made smaller, it is necessary to enlarge a tooth face width t of the starter gear 120 to provide sufficient strength. Accordingly, the one-way clutch 102 protrudes to an outer side in the axial length direction of the crank shaft 105, and a bank angle θ is limited. Further, it is necessary to enlarge a tooth face width of the small-diameter tooth portion 121*a* of the first idle gear 121 in correspondence to the starter gear 120, and the weight thereof is increased. Further, since the small-diameter tooth portion 121*a* overlaps the clutch outer member 116 as seen from a side direction (a direction of an arrow A), it is necessary to avoid interference between an outer peripheral wall 116*a* of the clutch outer member 116 and the small-diameter tooth portion 121*a* of the first idle gear 121 in an axial length direction of the crank shaft 105, and therefore, assembly is more complicated.

SUMMARY OF THE INVENTION

The present invention addresses the above described condition, and an object of the present invention is to provide an engine for a motorcycle capable of setting a large bank angle of the motorcycle and to have reduced size and weight.

In order to achieve the object mentioned above, in accordance with a first aspect of the present invention, there is provided an engine for a motorcycle that transmits a starting power from a starter motor to a crank shaft via a power transmission mechanism and a one-way clutch, wherein the one-way clutch is installed in one end portion of the crank shaft, and a starter gear or a starter sprocket (i.e., a starter rotary member) having a smaller diameter than an outer diameter of a clutch outer member of the one-way clutch is provided on the crank shaft in an outer side in an axial length direction of the crank shaft rather than the clutch outer member.

In accordance with the structure mentioned above, (1) since the clutch outer member of the one-way clutch is installed at one end portion of the crank shaft, the starter gear or the like is arranged further toward the outer side in the axial length direction of the crank shaft than the clutch outer member, and the outer diameter of the starter gear or the like is made smaller than the outer diameter of the clutch outer member, it is possible to increase a bank angle of the motorcycle.

(2) In the case that the starter gear is arranged further toward the outer side in the axial length direction of the crank shaft than the clutch outer member, it is possible to shorten, for example, the length of the idle gear engaging with the starter gear in the axial length direction of the crank shaft. Accordingly, it is possible to reduce the size and weight of the idle gear.

Preferably, the clutch outer member may be arranged further toward an outer side in the axial length direction of the crank shaft than a cam drive sprocket provided at one end portion of the crank shaft for driving a cam shaft mounted on a cylinder head of the engine through a cam chain provided between the cam drive sprocket and a cam driven sprocket provided on the cam shaft.

In accordance with the structure mentioned above, since the clutch outer member is arranged further toward the outer side in the axial direction of the crank shaft than the sprocket or the like for driving the cam, it is possible to enlarge, for example, an interval between the cam chain and the starter gear or the starter sprocket in the axial length direction of the crank shaft, and it is possible to avoid the interference between the cam chain or the like swinging during the operation and the starter gear or the like.

Preferably, an annular tooth portion of the starter gear may be notched obliquely at an outer periphery in an end portion in an outer side in the axial length direction of the crank shaft.

In accordance with the structure mentioned above, since the end portion of the tooth portion of the starter gear arranged further toward the outer side in the axial length direction of the crank shaft than the clutch outer member is notched obliquely, it is possible to further increase the bank angle of the motorcycle.

It is preferable that the power transmission mechanism may be provided with a plurality of idle gears coupling the starter gear and a pinion gear of a starter, the plurality of idle gears may include a first idle gear engaging with the starter gear, and a second idle gear engaging with the first idle gear and the pinion gear of the starter, and a first idler shaft supporting the first idle gear may be arranged within an area surrounded by the cam chain.

In accordance with the structure mentioned above, (1) since the first idler shaft of the first idle gear engaging with the starter gear is arranged within the area surrounded by the cam chain, it is possible to move the mounting position of the starter motor close to the crank shaft side, whereby it is possible to reduce the size of the engine and the starter apparatus. Further, since a gravity point of the starter motor comes close to the crank shaft side, it is possible to centralize the mass of the engine and the vehicle.

(2) Since a substance that would interfere with the idle shaft generally does not exist within the area surrounded by the cam chain, it is possible to easily position the idler shaft.

(3) Since the first idler shaft is arranged within the area surrounded by the cam chain, the first idle gear does not largely protrude from the cam chain region in the crank case, and it is easy to form the cover for the starter apparatus.

Preferably, a first cover covering the power transmission mechanism may be fixed to the crank case, a second cover may be arranged in a cover mounting surface at a peripheral edge of an opening formed in the first cover, one end portion of the first idler shaft may be fixed to the crank case, the other end portion thereof may be brought into contact with the first cover, and the first cover portion and the second cover portion at a position corresponding to the first idler shaft are together fastened to the other end portion of the first idler shaft by a male thread portion inserted to both the covers and a female thread portion engaging with the male thread portion.

In accordance with the structure mentioned above, since the opening portion is formed in the first cover, and the opening portion is covered by the second cover, it is possible to attach and detach the first idle gear within the starter chamber, for example, by detaching the second cover, and it is easy to assemble and maintain the power transmission mechanism.

Preferably, the opening of the first cover may be formed in a size at which the second idle gear can be inserted therethrough, and may be arranged so as to face to the second idle gear, and the second idle gear can be taken out to an external portion from the first cover by detaching the second cover.

In accordance with the structure mentioned above, attaching and detaching of the second idle gear can be easily executed.

In accordance with a second aspect of the present invention, there is provided an engine for a motorcycle that transmits a starting power to a crank shaft from a starter motor via a transmission mechanism and a one-way clutch, wherein a starter gear is provided in a crank shaft of the engine in an outer side in an axial length direction of the crank shaft rather than a cam chain for driving a cam shaft mounted on a cylinder head of the engine, and an idler shaft of an idle gear engaging with the starter gear is arranged within an area surrounded by the cam chain.

In accordance with the structure mentioned above, (1) since the idler shaft of the idle gear engaging with the starter gear is arranged within the area surrounded by the cam chain, it is possible to move the mounting position of the starter motor close to the crank shaft side, whereby it is possible to reduce the size of the engine and the starter apparatus. Further, since a gravity point of the starter motor comes close to the crank shaft side, it is possible to centralize the mass of the engine and the vehicle.

(2) Since a substance that would interfere with the idle shaft generally does not exist within the area surrounded by the cam chain, it is possible to easily position the idler shaft.

(3) Since the idler shaft is arranged within the area surrounded by the cam chain, the idle gear does not largely protrude from the cam chain region in the crank case, and it is easy to form the cover for the starter apparatus.

Preferably, a first cover covering the power transmission mechanism may be fixed to a crank case of the engine, a second cover may be arranged in a cover mounting surface at a peripheral edge of an opening formed in the first cover, one end portion of the idler shaft may be fixed to the crank case, the other end portion thereof may be brought into contact with the first cover, and the first cover and the second cover portion at a position corresponding to the idler shaft are together fastened to the other end portion of the idler shaft by a male thread portion inserted to both the covers and a female thread portion engaging with the male thread portion.

In accordance with the structure mentioned above, since the opening portion is formed in the first cover, and the opening portion is covered by the second cover, it is possible to attach and detach the idle gear within the starter chamber, for example, by detaching the second cover, and it is easy to assemble and maintain the power transmission mechanism.

Further, since both the covers are together fastened to the other end portion (leading end portion) of the idler shaft fixed to the crank case by the male thread portion inserted to the first and second covers and the female thread portion engaging with the male thread portion, it is possible to maintain a seal pressure in a mating face between the first cover and the second cover and it is possible to prevent oil within a starter chamber containing the power transmission mechanism from leaking, on the basis of the simple structure.

BRIEF DESCRIPTION OF THE DRAWINGS

The above and other objects, features and advantages of the present invention will be become more apparent from the following description taken in connection with the accompanying drawings, in which.

DETAILED DESCRIPTION OF THE INVENTION (Structure of Entire Engine)

Figure 1:
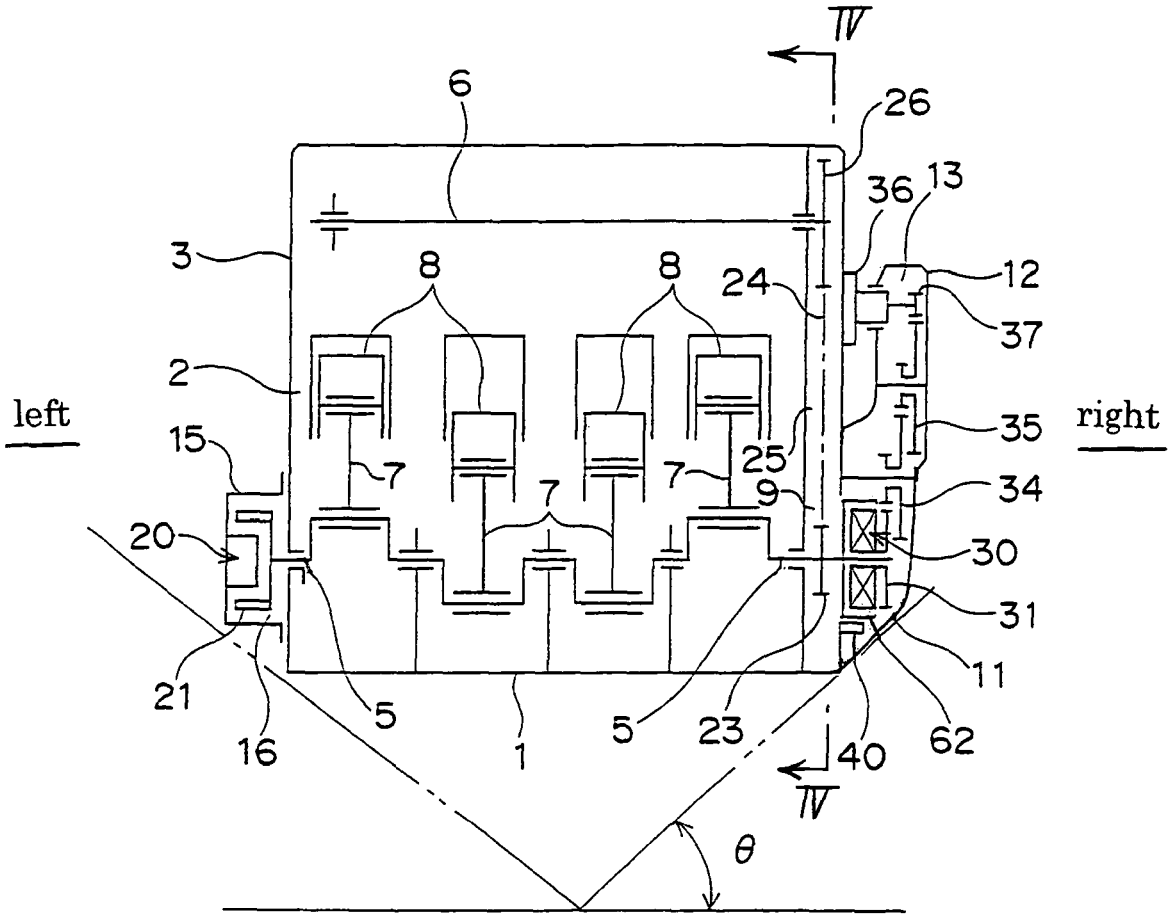
FIG. 1 is a vertical cross sectional schematic view of an engine for a motorcycle provided with a starter apparatus in accordance with an embodiment of the invention.

FIGS. 1 to 4 show an embodiment in accordance with the present invention, which is applied to a four-cylinder engine for a motorcycle. Four cylinders are arranged along a straight line. In FIG. 1 showing a vertical cross sectional schematic view of an entirety of the engine, an outer shell of the engine is constituted of a crank case 1, a cylinder (a cylinder block) 2, a cylinder head 3 and the like as is well known. A crank shaft 5 is rotatably supported within the crank case 1, and a cam shaft 6 for driving intake and exhaust valves is rotatably supported on the cylinder head 3. The crank shaft 5 is coupled to a piston 8 in each of the cylinders via a connecting rod 7. In other words, the engine is structured as a general DOHC engine.

A cam chain chamber 9 is formed in one end portion of the crank case 1 (a right end portion in FIG. 1) in an axial length direction of the crank shaft 5, a first cover 11 and a second cover 12 for a starter apparatus are attached thereto, and a starter chamber 13 is formed by both the first and second covers 11 and 12.

A generator cover 15 is attached to the other end portion of the crank case 1 (a left end portion in FIG. 1) in the axial length direction of the crank shaft 5, a generator chamber 16 is formed by the generator cover 15, a generator 20 is housed in the generator chamber 16, the other end portion of the crank shaft 5 protrudes into the generator chamber 16, and a generator rotor 21 is firmly fixed to the other end portion of the crank shaft 5.

In the following description, for convenience' sake, the "axial length direction of the crank shaft 5" mentioned above is called simply "crank axial length direction", the "one end side in the axial length direction of the crank shaft" where the starter apparatus is arranged is called "right side", and the "other end side in the axial direction of the crank shaft" where the generator is arranged is called "left side". In this case, the right and left mentioned above coincide with the right and left as seen from a rider on the motorcycle.

A right end portion of the crank shaft 5 protrudes to an inner side of the starter chamber 13 while passing through the cam chain chamber 9, and a cam drive sprocket 23 for driving a cam shaft 6 is integrally formed in the crank shaft 5 portion within the cam chain chamber 9. A cam chain 24 is wound around the cam drive sprocket 23, the cam chain 24 reaches over the cylinder head 3 while passing through the cam chain chamber 9 within the crank case 1 and a cam chain chamber 25 within the cylinder 2 and the cylinder head 3. The top of the cam chain 24 is wound around a cam driven sprocket 26 firmly fixed to the cam shaft 6 for the intake and exhaust valves.

A one-way clutch 30 and a starter gear 31 for the starter apparatus are arranged in a right end portion of the crank shaft 5 within the starter chamber 13, first and second idle gears 34 and 35 are sequentially arranged in an upper side of the starter gear 31, and an output pinion (gear) 37 of a starter motor 36 arranged on the crank case 1 is arranged in a top portion. Further, as an ignition signal detecting apparatus, a sensor 40 for detecting an ignition signal is arranged in an outer side in a radial direction of the one-way clutch 30 for the starter. The sensor 40 employs a magnetic sensor such as a pulsar coil or the like; however, it may employ various sensors such as an optical sensor utilizing a light receiving element or the like, a sensor utilizing a sound wave and the like.

Figure 4:
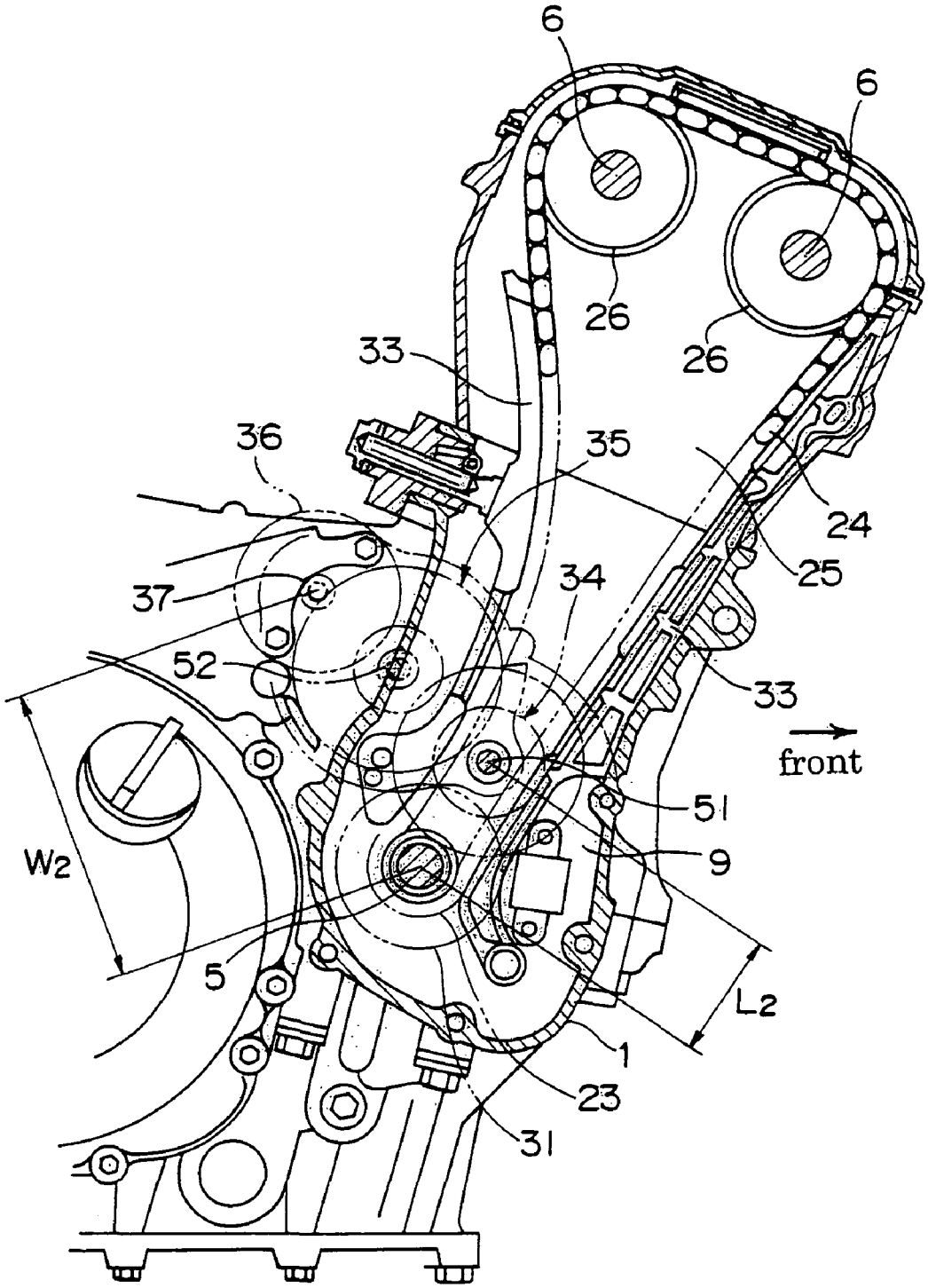
FIG. 4 is a cross sectional enlarged view along a line IV-IV in FIG. 1.
Figure 5:
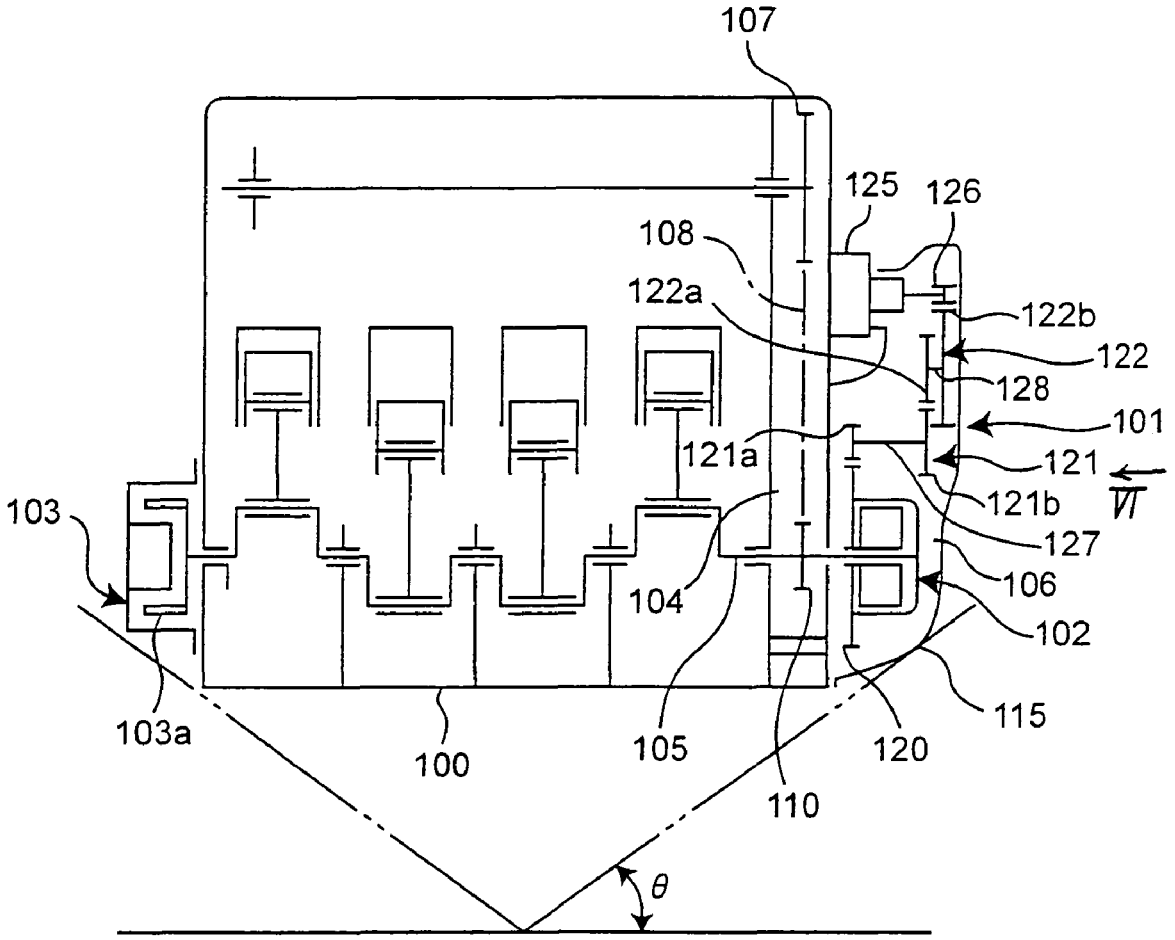
Fig.5 Prior Art
FIG. 5 is a vertical cross sectional schematic view of a conventional engine for a motorcycle.
Figure 6:
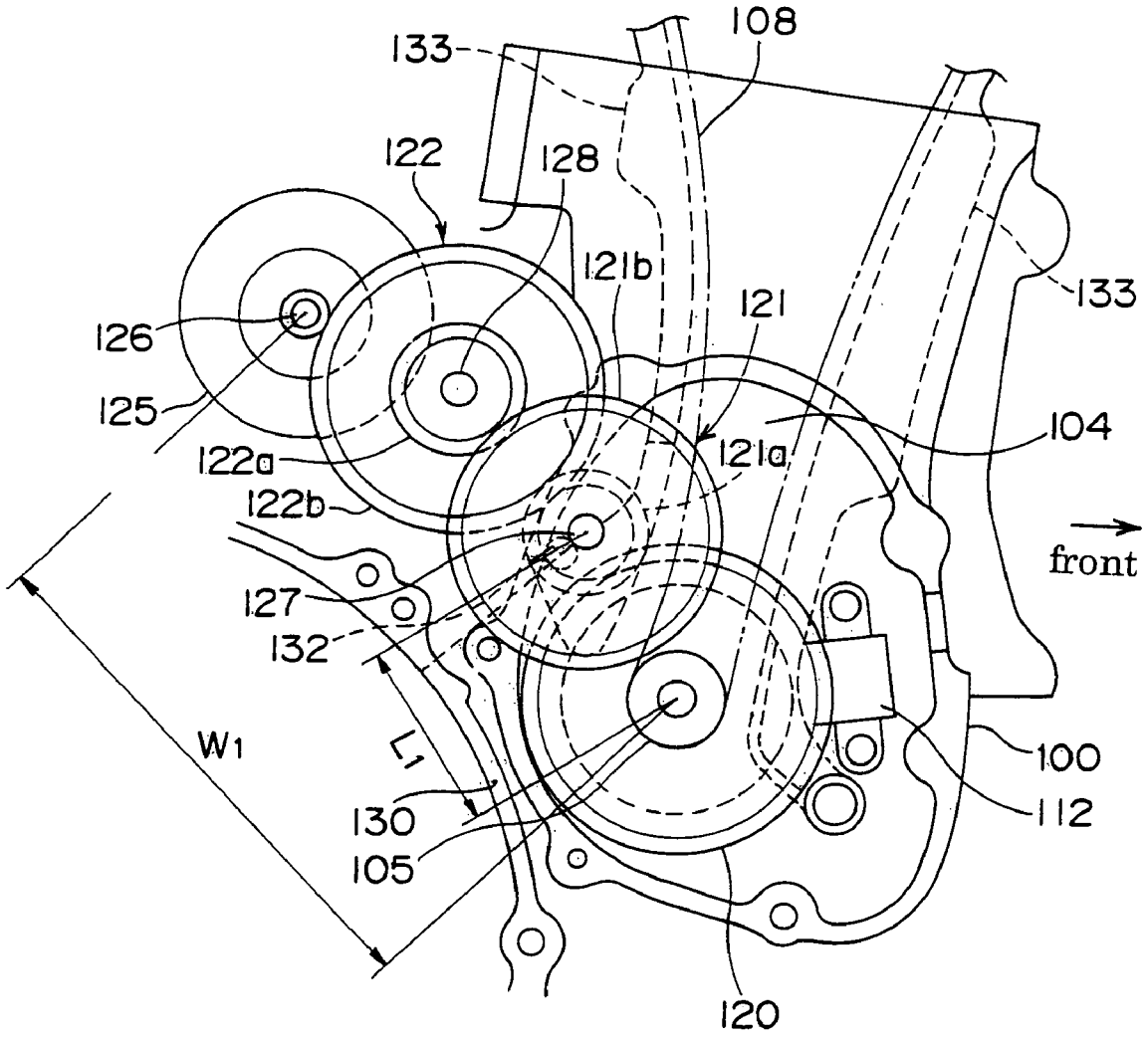
Fig.6 Prior Art
FIG. 6 is a view as seen from an arrow VI showing a state in which covers and the like of the starter apparatus in FIG. 5 are detached.
Figure 7:
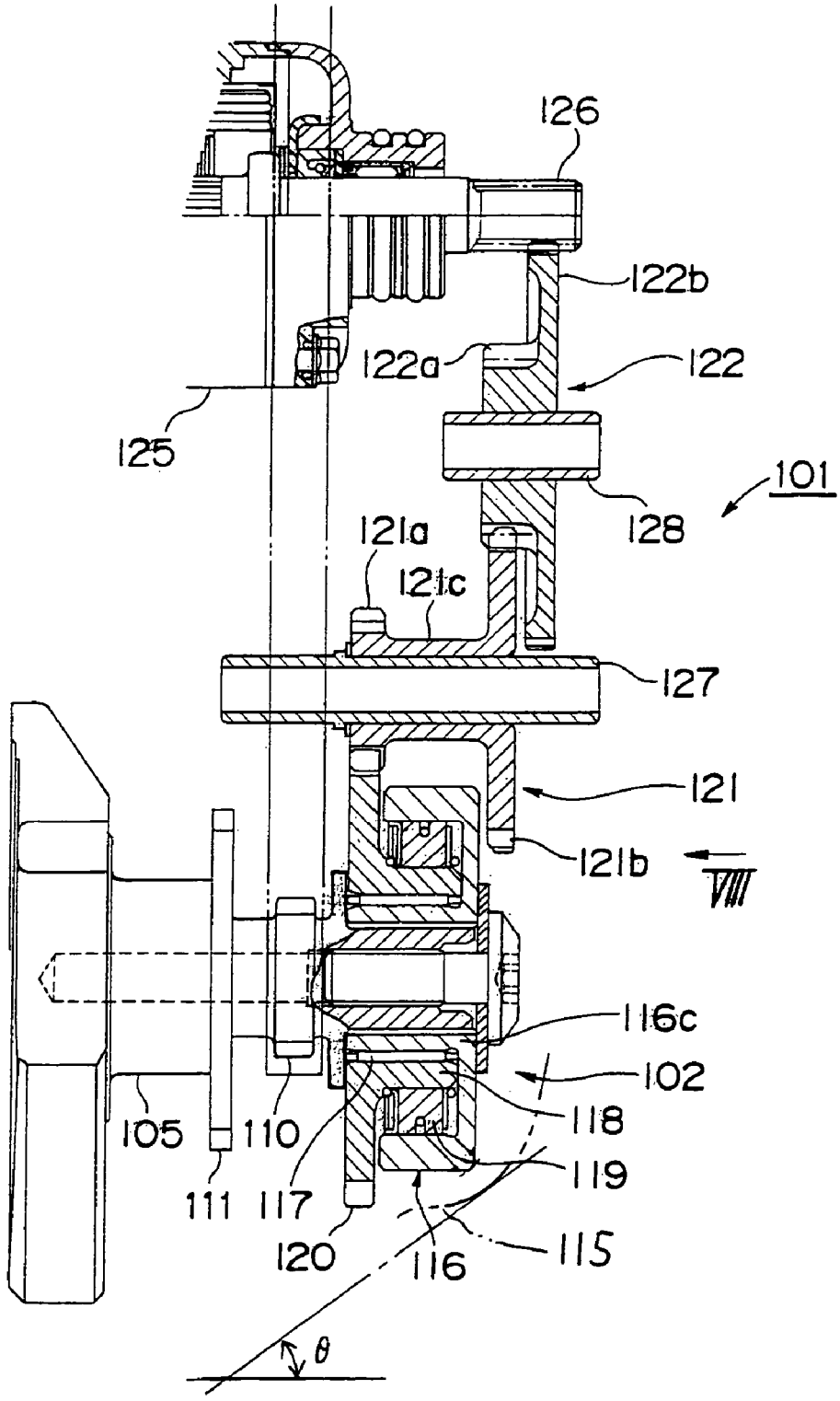
Fig.7 Prior Art
FIG. 7 is a cross sectional enlarged view of a starter apparatus of the engine for the motorcycle in FIG. 5.
Figure 8:
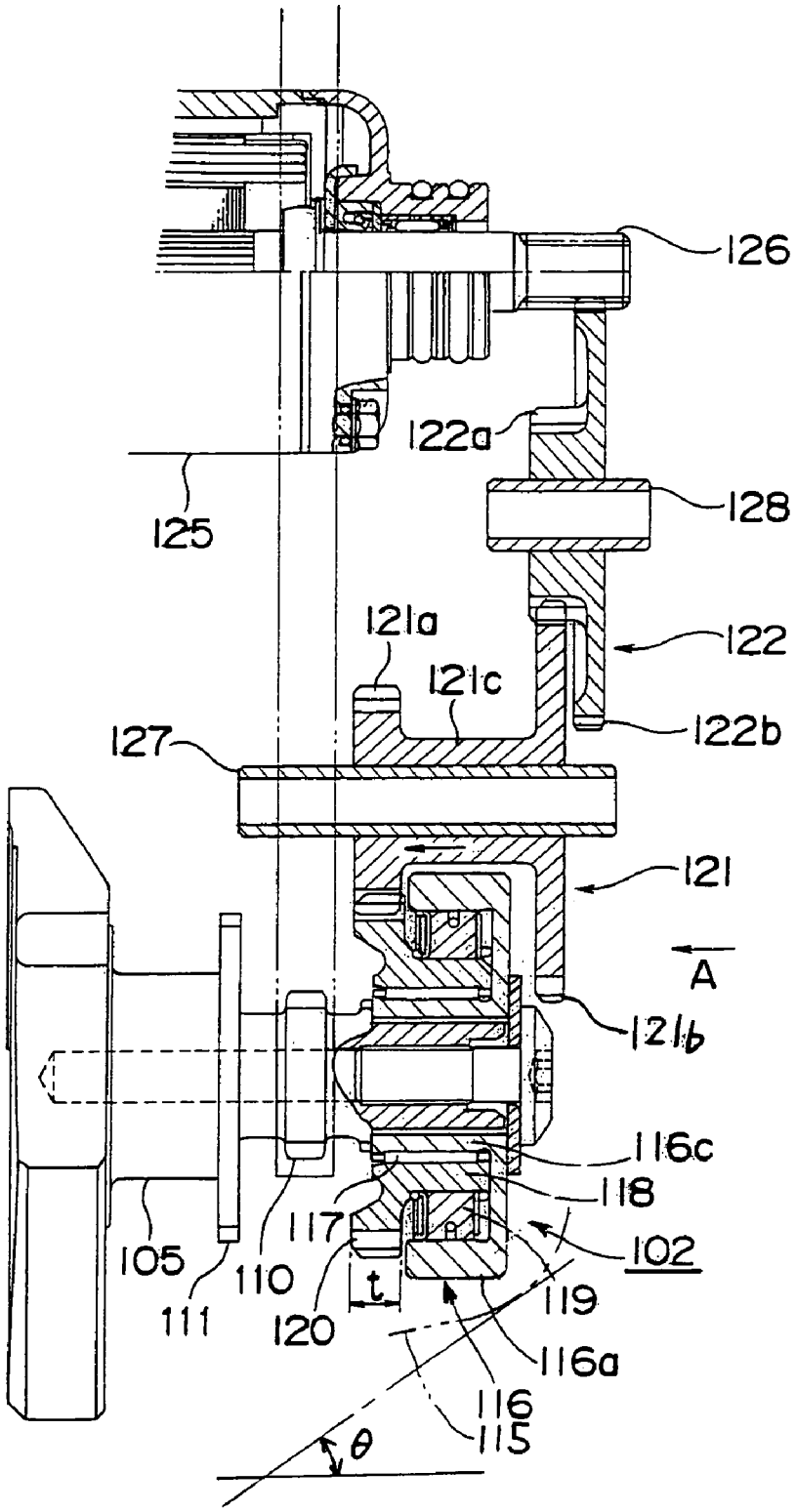
Fig.8 Prior Art
FIG. 8 is a cross sectional enlarged view of another prior art starter apparatus.

FIG. 4 is a cross sectional enlarged view along a line IV-IV in FIG. 1, and shows an inner side of the cam chain chambers 9 and 25. In FIG. 4, a pair of cam shafts 6 and 6 for the intake and exhaust valves are arranged so as to have an interval therebetween. The cam chain 24 is wound between the cam driven sprockets 26 and 26 of both the cam shafts 6 and 6 and the cam drive sprocket 23. The cam chain 24 is guided by front and rear chain guides 33 and 33 toward the lower side from both the cam driven sprockets 26 and 26, such that the interval between the front and rear portions of the cam chain 24 narrows toward the lower side, and the cam chain 24 reaches the cam drive sprocket 23.

(Starter Apparatus)

Figure 2:
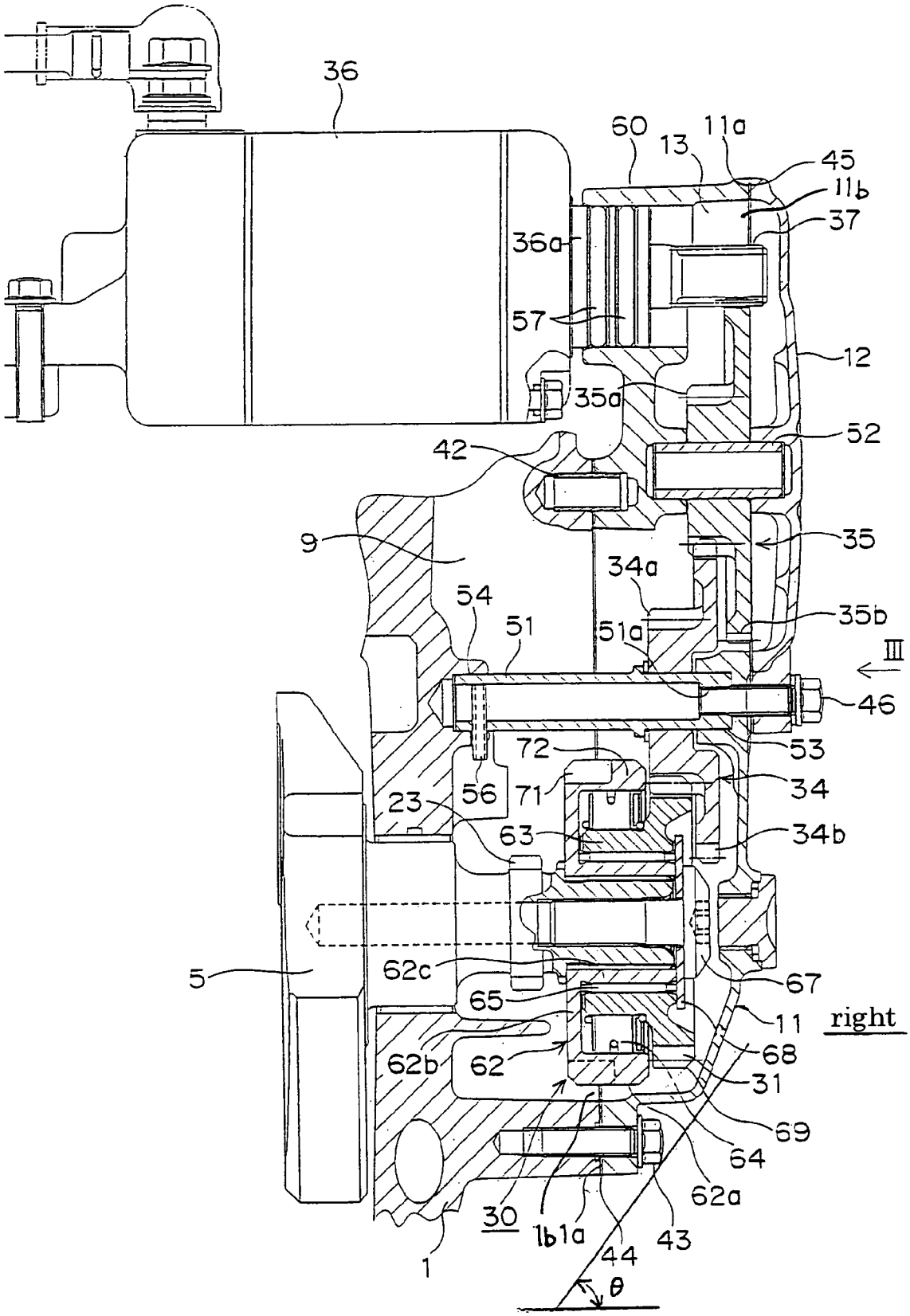
FIG. 2 is a vertical cross sectional enlarged view (a cross sectional view along a line II-II in FIG. 3) of a starter apparatus of the engine for the motorcycle in FIG. 1.

FIG. 2 is a vertical cross sectional enlarged view (a cross sectional view along a line II-II in FIG. 3) of the starter apparatus. An opening portion 1*b* is formed in a right end portion of the crank case 1, and a first cover mounting surface (a mating surface) 1*a* is formed around the opening portion 1*b*. The first cover 11 for the starter apparatus is positioned in the first cover mounting surface 1*a* by a positioning pin 42, and is fastened via a gasket 44 by a plurality of bolts 43. An opening portion 11*b* is formed in a right end and an upper half portion of the first cover 11, and a second cover mounting surface (a mating surface) 11*a* is formed around the opening portion 11*b*. The second cover 12 is positioned in the cover mounting surface 11*a* formed in the first cover 11 by a second idler shaft 52, and is fastened via a gasket 45 by a plurality of bolts 46. One of the bolts 46 is utilized as a male thread portion for together fastening both the covers 11 and 12 to a first idler shaft 51, and is engaged with a female thread (a female thread portion) 51*a* formed in a right end of the tubular first idler shaft 51. In other words, a right end portion of the first idler shaft 51 is fitted into a concave portion 53 formed in the first cover 11, is brought into contact with a bottom surface of the concave portion 53, and pinches the first cover 11 and the second cover 12 between a right end surface of the first idler shaft 51 and a head portion of the bolt 46 from right and left sides to improve a sealing performance in the cover mounting surface 11*a*. Further, a left end portion of the first idler shaft 51 passes through the cam chain chamber 9, is fitted to a concave portion 54 formed in a right end wall of the crank case 1, and is fixed to the crank case 1 by a lock pin 56 inserted in a radial direction so as to be non-rotatable and immobile in the axial length direction.

A small-diameter portion 36*a* at an output side of the starter motor 36 is fitted to a boss portion 60 of the first cover 11 via an O-ring 57. The second idle gear 35 integrally has a small-diameter tooth portion 35*a* and a large-diameter tooth portion 35*b*, and is rotatably supported by the second idler shaft 52, and the large-diameter tooth portion 35*b* is engaged with an output pinion (gear) 37 of the starter motor 36. The first idle gear 34 also integrally has a small-diameter tooth portion 34*a* and a large-diameter tooth portion 34*b*, the large-diameter tooth portion 34*b* is engaged with the small-diameter tooth portion 35*a* of the second idle gear 35, and the small-diameter tooth portion 34*a* is engaged with the starter gear 31. Both the idle gears 34 and 35 are formed such that the small-diameter tooth portions 34*a* and 35*a* and the large-diameter tooth portions 34*b* and 35*b* are adjacent in the crank axial length direction. In other words, the small-diameter tooth portions 34*a* and 35*a* in the left side and the large-diameter tooth portions 34*b* and 35*b* in the right side are positioned with no gap with each other in the crank axial length direction, and thereby the idle gears 34 and 35 are reduced in weight and in size in the crank axial length direction.

The one-way clutch 30 installed in a right end portion of the crank shaft 5 is constituted of a closed-end tubular clutch outer member 62, a tubular clutch inner member 63, and a clutch element 64 such as a sprag or the like.

The clutch outer member 62 is integrally provided with a disc-like end wall portion 62*b*, a tubular outer peripheral wall 62*a* and an inner peripheral boss portion 62*c*, is arranged in a right side of the cam drive sprocket 23 (an outer side in the crank axial length direction), and is always integrally rotated with the crank shaft 5 on the basis of the inner peripheral boss portion 62*c* being spline fitted to the crank shaft 5.

The clutch inner member 63 faces the tubular outer peripheral wall 62*a* from an inner side in the radial direction with an interval, and an inner peripheral surface thereof is rotatably fitted to an outer peripheral surface of the inner peripheral boss portion 62*c* of the clutch outer member 62 via a needle bearing 65.

The clutch element 64 is arranged between the outer peripheral wall 62*a* of the clutch outer member 62 and the clutch inner member 63, and is expanded in a radial direction on the basis of a rotation in an engine normal rotating direction of the clutch inner member 63, and is structured such as to connect the clutch inner member 63 and the clutch outer member 62. In other words, the structure is made such that the starting power in the engine normal rotating direction is transmitted only to the clutch outer member 62 side (the crank shaft 5 side) from the clutch inner member 63 side at a time of starting the engine.

The inner peripheral boss portion 62*c* of the clutch outer member 62 and the clutch inner member 63 are locked by a come-off preventing bolt 67 screwed to a right end of the crank shaft 5 via a come-off preventing washer 68 so as not to be mobile in the crank axial length direction.

A right end portion of the clutch inner member 63 extends to a right side (an outer side in the crank axial length direction) from the outer peripheral wall 62*a* of the clutch outer member 62, and the starter gear 31 is integrally formed in the right end portion. In other words, the starter gear 31 is arranged at the right side (the outer side in the crank axial length direction) of the clutch outer member 62.

The starter gear 31 is formed to have a smaller diameter than an outer diameter of the outer peripheral wall 62*a* of the clutch outer member 62, and an oblique notch 69 is formed at an outer periphery in a right end portion of the tooth portion. In accordance with the structures mentioned above, a bank angle θ with respect to a horizontal surface (a ground surface) can be set larger.

Figure 3:
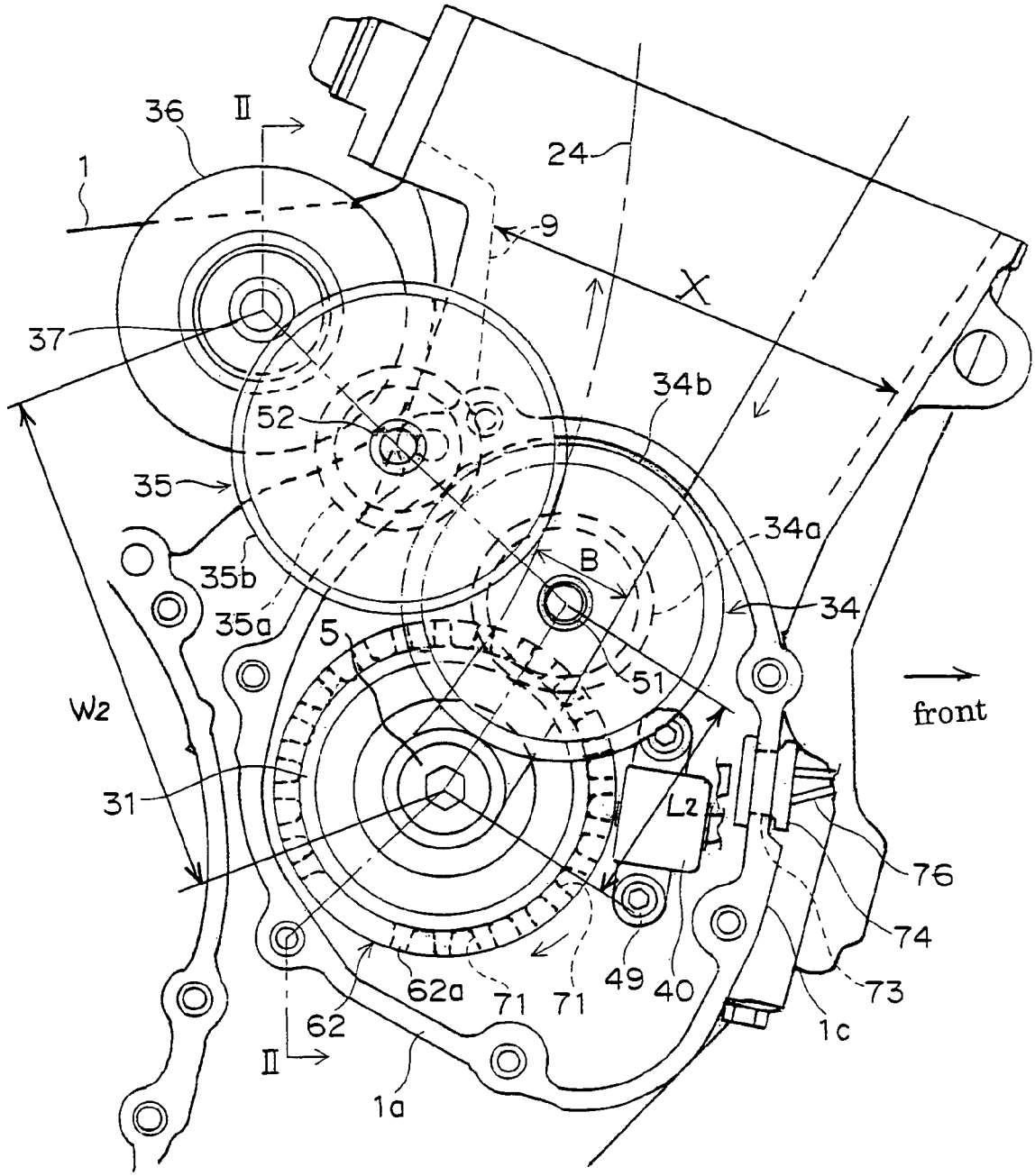
FIG. 3 is a view as seen from an arrow of III of the starter apparatus in FIG. 2 in a state in which respective covers for the starter apparatus are detached.

FIG. 3 is a view as seen from an arrow III in FIG. 2 and shows a state in which the covers 11 and 12 are detached. The starter motor 36 is arranged adjacent to a rear side of the cam chain chamber 9 of the crank case 1, and the first idler shaft 51 of the first idle gear 34 engaging with the starter gear 31 is arranged within an area surrounded by the cam chain 24 (an inner side of the cam chain line). In particular, the first idler shaft 51 is arranged in an approximately center portion of an interval B between front and rear portions of the cam chain 24, and is positioned approximately in a center portion of a width X of the cam chain chamber 9 in the front and rear direction.

The opening portion 1*b* formed in the crank case 1 is formed in such a shape and a dimension that the one-way clutch 30, the starter gear 31 and the first idle gear 34 can be inserted and pulled out in the axial direction. In FIG. 2, the opening portion 11*b* formed in the first cover 11 is formed in such a size and shape that the second idle gear 35 can be inserted and pulled out in the axial direction.

(Ignition Signal Detecting Apparatus)

In FIG. 2, a lot of signal outputting teeth 71 are formed as a signal output portion of the ignition signal detecting apparatus on an outer peripheral surface of the outer peripheral wall 62*a* of the clutch outer member 62 in accordance with a cutting process. The signal outputting teeth 71 are formed from a left end edge of the outer peripheral wall 62*a* (an inner end edge in the crank axial length direction) to a middle in the crank axial length direction of the outer peripheral wall 62*a*, and an annular reinforcing portion 72 which is thicker than a thickness of a bottom (a bottom surface) of the signal outputting teeth 71 is integrally formed in a right opening end portion of the outer peripheral wall 62*a*. In this case, the signal outputting teeth 71 may be formed in accordance with a mold process or a cold forging in addition to the cutting process mentioned above.

In FIG. 3, the sensor 40 is arranged in a front side of the clutch outer member 62, faces the signal outputting teeth 71 of the outer peripheral wall 62*a* across a predetermined small gap, and is fixed to a right end wall of the crank case 1 by a bolt 49. Two lead wires 76 for transmitting a pulse signal from the sensor 40 extend out to an external portion through an insertion hole (a notch) 73 formed in the starter chamber forming wall 1*c* of the crank case 1, an eyelet-shaped rubber packing 74 is fitted to the insertion hole 73 so as to seal between the lead wire 76 and the insertion hole 73, and the lead wires 76 are held by the rubber packing 74.

(Operation)

When driving the starter motor 36 in FIG. 2 for starting the engine, the output of the starter motor 36 is transmitted from the output pinion 37 via the large-diameter tooth portion 35*b* of the second idle gear 35, in the following order of the small-diameter tooth portion 35*a* of the second idle gear 35, the large-diameter tooth portion 34*b* of the first idle gear 34, the small-diameter tooth portion 34*a* of the first idle gear 34, the starter gear 31, the clutch inner member 63, the clutch element 64, the clutch outer member 62, and finally to the crank shaft 5, and then the engine is started.

After starting, the starter motor 36 stops. However, in the one-way clutch 30, only the clutch outer member 62 is rotated together with the crank shaft 5.

(1) Since the cam drive sprocket 23 for driving the cam shafts 6, the one-way clutch 30 and the starter gear 31 are arranged in an order from the inner side in the axial length direction of the crank shaft 5, at one end portion (the right end portion) in the axial length direction of the crank shaft 5, and the outer diameter of the starter gear 31 arranged at the outermost side in the axial length direction of the crank shaft 5 is set smaller than the outer diameter of the clutch outer member 62 of the one-way clutch 30, it is possible to integrally form the large and small tooth portions 34*b* and 34*a* of the first idle gear 34 in a state of being adjacent in the axial length direction of the crank shaft 5 as shown in FIG. 2, it is possible to reduce the size and weight of the first idle gear 34, and it is possible to set the bank angle θ in the motorcycle large. Further, it is possible to set the bank angle θ even larger, by forming the notch 69 in the tooth portion of the starter gear 31.

(2) Since the first idler shaft 51 is arranged within the area surrounded by the cam chain, it is possible to move the mounting position of the starter motor 36 close to the crank shaft side as shown in FIG. 3, whereby it is possible to intend to reduce the size of the engine. Further, since the gravity point of the starter motor 36 comes close to the crank shaft 5 side, it is possible to centralize the mass of the engine and the vehicle. Further, since no interference substance normally exists within the area surrounded by the cam chain, it is possible to easily position the first idler shaft 51.

(3) Since the first idler shaft 51 is arranged within the area surrounded by the cam chain, the first idle gear 34 does not largely protrude from the cam chain arranged area of the crank case 1, and it is possible to easily form the first and second covers 11 and 12 and the like.

(4) Since the opening portion 11*b* by which the second idle gear 35 can be inserted and pulled out in the axial direction is formed in the first cover 11, and the second cover 12 is attached to the opening portion 11*b*, it is possible to insert the second idle gear 35 into the starter chamber 13 so as to attach by detaching the second cover 12 without detaching the first cover 11, and the gear power transmission mechanism can be easily assembled and maintained.

Other Embodiments (1) In FIGS. 1 and 2, although the cam drive sprockets for the cam chain are provided as the rotating members for driving the cam shafts, the present invention can be applied to an engine for a motorcycle having a structure in which normal mating gears are provided as the rotating members for driving the cam shafts.

(2) In the embodiment shown in FIG. 2, the bank angle of the motorcycle is enlarged by installing the one-way clutch 30 at one end portion of the crank shaft 5, and arranging the starter gear 31 having the diameter smaller than the outer diameter of the clutch outer member 62 in the crank shaft 5 portion in the outer side in the axial length direction. However, the present invention can be applied to an engine for a motorcycle in which a sprocket for a chain is provided in place of the starter gear 31 (as a starter rotary member), and a power transmission mechanism comprising a sprocket and a chain is provided between the starter motor 36 and the one-way clutch 30.

(3) In FIG. 2, as a structure in which the first and second covers 11 and 12 are together fastened to the right end surface of the idler shaft 51, the female thread (the female thread portion) 51*a* is formed in the right end surface of the idler shaft 51, and the bolt (the male thread portion) 46 having the head portion is inserted to the first and second covers 11 and 12 from the outer side (the right side) and is engaged with the female thread 51*a*. However, the female thread portion and the male thread portion can be reversely provided. In other words, the structure can be made such that a male thread portion protruding to a right side is integrally formed in a right end portion of the idler shaft 51, the male thread portion is inserted to the first and second covers 11 and 12, and a nut corresponding to the female thread portion is engaged with a leading end portion of the male thread portion protruding to the right side from the second cover 12.

(4) In FIG. 2, the structure can be made such that both the covers 11 and 12 are directly coupled without interposing the gasket 44 between the first cover 11 and the second cover 12.

Although the invention has been described in its preferred embodiments with a certain degree of particularity, obviously many changes and variations are possible therein. It is therefore to be understood that the present invention may be practical otherwise than as specifically described herein without departing from the scope and spirit thereof.

What is claimed is:

1. An engine arrangement for a motorcycle, comprising:

a crank case;

a crank shaft rotatably supported in said crank case, said crank shaft having first and second opposite axial ends;

a piston movably mounted in said crank case for reciprocating movement within a cylinder, and a piston connecting rod coupling said piston to said crank shaft in such a manner as to cause conversion between rotary motion of said crank shaft and reciprocating movement of said piston connecting rod and said piston;

a starter rotary element coupled at said first axial end of said crank shaft and configured for coupling to a starter motor, said starter rotary element being constituted by one of a starter gear and a starter sprocket;

a one-way clutch, provided at said first axial end of said crank shaft, operably coupled between said crank shaft and said starter rotary element, so as to transmit rotary motion between said starter rotary element and said crank shaft in a first rotary direction but not in a second rotary direction opposite said first rotary direction;

wherein said one-way clutch includes a clutch outer member, and an outer diameter of said starter rotary element is smaller than an outer diameter of said clutch outer member;

wherein said piston connecting rod is coupled to said crank shaft at a location disposed in an axially inward direction from said first end of said crank shaft; and wherein said starter rotary element is disposed axially outwardly of said clutch outer member on an axial side of said clutch outer member opposite said location at which said piston connecting rod is coupled to said crank shaft.

2. An engine arrangement as claimed in claim 1, wherein said clutch outer member is coaxial with said starter rotary element.

3. An engine arrangement as claimed in claim 2, wherein said one-way clutch further includes a clutch inner member disposed radially inwardly of said clutch outer member; and said starter rotary element is fixed for rotation with said clutch inner member.

4. An engine arrangement as claimed in claim 3, wherein said one-way clutch further includes a clutch element operably coupled between said clutch inner member and said clutch outer member to selectively couple said clutch inner member and said clutch outer member for rotation together in said first rotary direction.

5. An engine arrangement as claimed in claim 1, wherein said starter rotary element includes an annular tooth portion, and an axially outer end of said annular tooth portion is obliquely notched at an oblique angle with respect to an axial direction of said crank shaft.

6. An engine arrangement as claimed in claim 1, wherein a cam drive rotary element is mounted to said crank shaft for driving a cam, said cam drive rotary element constituting one of a cam drive gear and a cam drive sprocket; and said clutch outer member is disposed axially outwardly of said cam drive rotary element on a side of said cam drive rotary element opposite said location at which said piston connecting rod is coupled to said crank shaft.

7. An engine arrangement as claimed in claim 6, wherein said starter rotary element is a starter gear, and said cam drive rotary element is a cam drive sprocket;

a power transmission is coupled to said starter gear for transmitting power to said starter gear from a pinion gear of a starter motor;

said power transmission includes a plurality of idle gears including a first idle gear engaged with said starter gear, and a second idle gear arranged to engage with the pinion gear of the starter motor;

a cylinder head is mounted with respect to said crank case;

first and second cam shafts for driving intake and exhaust valves are rotatably supported in said cylinder head;

first and second sprockets are respectively fixed for rotation with said first and second cam shafts to operate piston intake and exhaust valves;

a cam chain is trained about said first and second sprockets and said cam drive sprocket so that said cam drive sprocket is arranged to drive the intake and exhaust valves via said cam chain and said first and second cam shafts; and an idler shaft supports said first idle gear for rotation upon rotation of said starter gear, and said idle shaft is arranged within an area surrounded by said cam chain trained about said first and second sprockets and said cam drive sprocket.

8. An engine arrangement as claimed in claim 7, wherein a first cover is fixed to said crank case to cover the power transmission, said first cover having an opening surrounded by a peripheral edge with a cover mounting surface;

a second cover is mounted to said cover mounting surface of said peripheral edge surrounding said opening of said first cover;

a first end portion of said idler shaft is fixed to said crank case, and a second end portion of said idler shaft contacts said first cover;

a male threaded member is inserted into both of said first and second covers and couples said first and second covers to said second end portion of said idler shaft via engagement with female threads.

9. An engine arrangement as claimed in claim 8, wherein said opening of said first cover and said second idle gear are sized so that said second idle gear is insertable through said opening, and said second idle gear is disposed to face said opening of said first cover so that said second idle gear is removable through said opening upon detachment of said second cover from said first cover.

10. An engine arrangement as claimed in claim 1, further comprising the starter motor, said starter motor having an output pinion; and wherein said output pinion, said one-way clutch, and said starter rotary element are accommodated in a starter chamber surrounded by covers.

11. An engine arrangement as claimed in claim 1, wherein said starter rotary element is coaxial with said crank shaft.

12. An engine arrangement as claimed in claim 11, wherein said cam drive rotary element is coaxial with said crank shaft.

13. An engine arrangement as claimed in claim 1, wherein said cam drive rotary element is coaxial with said crank shaft.

14. An engine arrangement as claimed in claim 1, wherein the one-way clutch includes the clutch outer member, a clutch inner member and a clutch element, said clutch inner member having two opposite axial end portions;

said clutch outer member is integrally provided with a disc-shaped end wall portion, a tubular outer peripheral wall and an inner peripheral boss portion, said tubular outer peripheral wall having two opposite axial end portions;

said inner peripheral boss portion is spline fitted to said crank shaft so as to be integrally rotated with said crank shaft;

said disc-shaped end wall portion connects said tubular outer peripheral wall with said inner peripheral boss portion at the one of said two axial end portions of said tubular outer peripheral wall closest to the location at which said piston connection rod is coupled to said crank shaft;

said clutch inner member is arranged between said tubular outer peripheral wall and said inner peripheral boss portion in a radial direction;

said clutch element is arranged between said outer peripheral wall and said clutch inner member to transmit starting power to said clutch outer member from said clutch inner member upon starting of the starter motor; and said starter rotary element is integrally formed with said clutch inner member at the one of said two axial end portions of said clutch inner member most remote from the location at which said piston connecting rod is coupled to said crank shaft, and is formed to have a smaller diameter than an outer diameter of said outer peripheral wall.

15. An engine arrangement for a motorcycle, comprising:

a crank case;

a crank shaft rotatably supported in said crank case, said crank shaft having first and second opposite axial ends;

a piston movably mounted in said crank case for reciprocating movement within a cylinder provided in a cylinder head, and a piston connecting rod coupling said piston to said crank shaft in such a manner as to cause conversion between rotary motion of said crank shaft and reciprocating movement of said piston connecting rod and said piston;

a starter gear coupled to said crank shaft and configured for coupling to a starter motor;

an idle gear rotatably engaged with said starter gear;

an idler shaft supporting said idle gear for rotation upon rotation of said starter gear;

a first sprocket fixed for rotation with said crank shaft;

first and second cam shafts for driving intake and exhaust valves are rotatably supported in said cylinder head;

second and third sprockets respectively fixed for rotation with said first and second cam shafts to operate piston intake and exhaust valves; and a cam chain trained about said first, second and third sprockets;

wherein said idler shaft is arranged within a range surrounded by said cam chain trained about said first, second and third sprockets;

wherein said piston connecting rod is coupled to said crank shaft at a location disposed axially inwardly of said starter gear; and wherein said starter gear is disposed axially outwardly of said cam chain on an axial side of said cam chain opposite said location at which said piston connecting rod is coupled to said crank shaft.

16. An engine arrangement as claimed in claim 15, further comprising a one-way clutch operably coupled between said crank shaft and said starter gear so as to transmit rotary motion between said starter gear and said crank shaft in a first rotary direction but not in a second rotary direction opposite said first rotary direction.

17. An engine arrangement as claimed in claim 15, wherein a first cover is fixed to said crank case to cover a power transmission including said idle gear, said starter gear and said one-way clutch, said first cover having an opening surrounded by a peripheral edge with a cover mounting surface;

a second cover is mounted to said cover mounting surface of said peripheral edge surrounding said opening of said first cover;

a first end portion of said idler shaft is fixed to said crank case, and a second end portion of said idler shaft contacts said first cover;

a male threaded member is inserted into both of said first and second covers and couples said first and second covers to said second end portion of said idler shaft via engagement with female threads.

18. An engine arrangement as claimed in claim 15, wherein said starter gear is coaxial with said crank shaft.

19. An engine arrangement as claimed in claim 18, wherein said first sprocket is coaxial with said crank shaft.

20. An engine arrangement as claimed in claim 15, wherein said first sprocket is coaxial with said crank shaft.

* * * * *